United States Patent [19]

Busley

[11] Patent Number: 5,038,657

[45] Date of Patent: Aug. 13, 1991

[54] STRING TENSIONING APPARATUS FOR A MUSICAL INSTRUMENT

[76] Inventor: Bradford M. Busley, 384 S. Ironton St., #413, Aurora, Colo. 80012

[21] Appl. No.: 547,481

[22] Filed: Jul. 2, 1990

[51] Int. Cl.[5] ..... G10G 7/02

[52] U.S. Cl. ..... 84/455; 84/DIG. 18

[58] Field of Search ..... 84/200, 454, 455, DIG. 18

[56] References Cited

U.S. PATENT DOCUMENTS

| | | | |
|---|---|---|---|
| 2,136,627 | 11/1938 | Lohman | 84/313 |
| 4,100,832 | 7/1978 | Peterson | 84/313 |
| 4,313,361 | 2/1982 | Deutsch | 84/454 X |
| 4,375,180 | 3/1983 | Scholz | 84/454 |
| 4,426,907 | 1/1984 | Scholz | 84/454 |
| 4,434,696 | 3/1984 | Conviser | 84/1.01 |
| 4,457,203 | 7/1984 | Schoenberg et al. | 84/454 |
| 4,512,232 | 4/1985 | Schaller | 84/313 |
| 4,584,923 | 4/1986 | Minnick | 84/454 |
| 4,648,304 | 3/1987 | Hoshino et al. | 84/313 |
| 4,665,790 | 5/1987 | Rothschild | 84/454 |
| 4,732,071 | 3/1988 | Deutsch | 84/454 |
| 4,803,908 | 2/1989 | Skinn et al. | 84/454 |
| 4,909,126 | 3/1990 | Skinn et al. | 84/454 |

*Primary Examiner*—Russell E. Adams
*Assistant Examiner*—Jae N. Noh
*Attorney, Agent, or Firm*—Dorr, Carson, Sloan & Peterson

[57] ABSTRACT

The string tensioning apparatus includes a string tensioning device to provide the mechanical string tension control function and associated control electronics to regulate the operation of the string tensioning device. The string tensioning device includes a bidirectional motor as the mechanical means to vary, control and maintain string tension. The associated string is directly connected to the motor shaft, whose rotation is regulated by the associated control electronics. A transducer is used to measure the frequency of operation of each string. The measured frequency is then compared to a value stored in memory to produce an indication of the difference between the actual and desired frequency of operation. This difference is then used to control the direction and amount of rotation of the motor shaft to bring the string frequency of operation into compliance with the stored frequency value.

29 Claims, 5 Drawing Sheets

STRING TENSIONING APPARATUS FOR A MUSICAL INSTRUMENT

FIELD OF THE INVENTION

This invention relates to string musical instruments and specifically, it relates to devices that control the amount of string tension for tuning, vibrato and other pitch variation effects.

PROBLEM

It is a problem to precisely control string tension to produce the correct vibrational frequencies for string musical instruments such as guitars, basses, violins, violas and cellos. With string instruments, machine heads and tuning pegs are the common tensioning means for adjusting string tensions to tune the instrument. The initial adjustment to obtain precise string tension is a very tedious task for every performer. With new strings, the performer must first continually tension and retension each string until their resiliency stabilizes. With stable string resiliencies, the performer now must continually adjust and readjust string tensions until the resiliencies of the instrumental materials are stabilized in relation to the force produced by the strings when they are correctly tensioned to produce the desired frequencies. This all must be done manually by the performer through rotation of the tuning knob of each string's respective machine head or tuning peg until each string and therefore the instrument is in tune. Unfortunately, during a performance the performer is also required to continually adjust and readjust the tensions of the strings because of the inherent position slippage of the tensioning means due to the applied string tensions, the techniques of string engagement and the influence of the environment on the stability of instrument materials. This continual manual adjustment of string tensions can be very frustrating, time consuming and difficult, depending upon the situation, the instrument and the performer.

The automatic string tuning devices found within the string musical instrument art attempt to minimize the difficulties associated with tuning an instrument by ear. The automatic tuning devices of D. T. Scholz in U.S. Pat. Nos. 4,375,180 and 4,426,907, Gregory B. Minnick in U.S. Pat. No. 4,584,923 and U.S. Pat. No. 4,803,908 to Neil C. Skinn et al., each include the usage of an independent motor per string for varying string tensions over a limited range. Each of these devices have several common inherent design problems. First, all use some type of custom complex mechanical lever system in combination with the motors. The choice of using a lever system for increasing the torque capacity of a motor relative to controlling the amount of string tension is a poor design choice since this arrangement is mechanically complex and has a limited tuning range. Secondly, these systems do not allow the performer to selectively tune a multiplicity of selected strings at the same time, which eliminates player tuning discretion in that the performer must either tune one string at a time or tune all of the strings at once. Thirdly, none of these lever systems provide for easy variability of device frequency presets in relation to other instruments, tuning standards and tuning relationships. Fourthly, these systems provide no capability for the production and control of vibrato and other frequency variation effects due to the lack of proper control electronics in combination with the limited range, speed and instability of the lever systems. Finally, the major design flaw with each of these mechanical devices is that they all require the use of machine heads to initially tension the strings within the limited tuning range of these systems.

Because of these limitations, the musical instrument goes out of tune just as often as non-automated musical instruments due to the inherent position slippage of the machine heads. If the machine head slips far enough, the performer has to detension the string, cause the motor to rotate to reposition the lever system back into its range of control motion, manually return the string to a nominal tuned position via the machine head and then engage the device again for fine tuning. If this happens during a performance, the performer has to tune the string manually, thus negating the advantages of having a string musical instrument equipped with an automatic string tensioning device. In essence, these devices are remedial systems which attempt to treat the effects of the basic string tensioning problem rather than being a cure to treat the cause of the problem, and that problem is the use of machine heads on string musical instruments.

With automatic tuning devices, there are a variety of standard circuits to provide the frequency comparison functions. The following patents illustrate a few examples of the diversity of electronic means for providing the frequency comparison function and with the proper implementation, their concepts may be adapted to the present invention depending upon the specific requirements as determined by the performer and the type of instrument implementing the present invention. These include: U.S. Pat. No. 4,313,361 to Ralph Deutsch relative to sampling techniques; U.S. Pat. No. 4,434,696 to Harry Conviser relative to phase locked loops; U.S. Pat. No. 4,457,203 to Steve A. Schoengerg relative to peak voltage detection; U.S Pat. No. 4,665,790 to Standley Rothschild relative to zero crossing detection; and U.S. Pat. No. 4,732,071 to Ralph Deutsch relative to the Fourier Transform.

Many string musical instruments also include devices that allow for the variation of string tensions to produce changes in string frequencies for an expansion of expression during play. Depending upon the engagement of the device, the performer can produce a wide range of pitch variation effects from quick vibratos to slow slides. Within the art, a wide diversity of designs exist for these frequency variation devices. A common misusage of terminology exists within the art in referring to these devices as tremolo devices when they are in fact devices that produce vibratos. Tremolo is a periodic change in amplitude or "volume" and vibrato is a periodic change in frequency or "pitch". A clarification of this terminology is necessary for an exact understanding of certain unique capabilities of the present invention as is described herein.

The majority of these frequency variation devices are for monophonic play, only because they do not provide the necessary variable longitudinal compensation required to keep the strings in relative tune with each other during the activation of the frequency variation device. With these frequency variation devices, each string is displaced the same longitudinal distance about a fixed rotational line when the performer engages the frequency variation device. For strings to stay in relative tune with each other during tensioning variation, each string must be displaced a different longitudinal amount to compensate for the diversity between string tensions, materials, lengths, diameters and constructions. Because existing frequency variation devices do not provide for longitudinal compensation, they produce very unappealing inharmonic sounds when the performer initiates vibrations on at least two of the strings at the same time while also engaging the frequency variation device. U.S Pat. No. 4,512,232 to Helmut F. K. Schaller is an example of one such inharmonic vibrato device.

The inharmonic vibrato device of M. L. Lohman in U.S. Pat. No. 2,136,627 includes a motor wherein the construction of this device provides for electronic control over the transversal motion of the guitar's bridge to produce vibrato effects via pedal control. This vibrato device is obviously highly limited in its capabilities. James R. Peterson's U.S. Pat. No 4.100,832 is another example of an inharmonic vibrato device that incorporates an electric motor 12 as a means for periodically varying a lever and cam mechanism that secures the strings. The main problem with this vibrato device is that it repeatedly varies all string tensions at the same time and in a finite manner without regard to chromatic pitch relationships. This produces highly unappealing monophonic and polyphonic inharmonic vibratos, requires cam replacement for vibrato frequency range variations and requires the performer to manually move lever 31 to mechanically engage contact between device components, turn the device on with on/off switch 14, set the rate of vibrato via speed control rheostat 15, turn the device off via on/off switch 14 and then to disengage contact between device components again via lever 31 each time the performer engages the vibrato device during play. This system of frequency variation engagement is obviously very awkward and distracting to right hand picking and independent playing techniques. The design of this vibrato device also prevents the creation of other pitch variation effects during device engagement and only provides unappealing inharmonic vibratos due to its structural lack of compensation for string diversities.

U.S. Pat. No. 4,648,304 to Yoshiki Hoshino and Kazuhiro Matsui is an example of a vibrato device that provides longitudinal string length compensation to enable the strings to stay in relative tune with each other during vibrato device engagement, thus allowing for polyphonic play. In general, these vibrato devices provide greater musical capabilities and are therefore more beneficial in a musical environment, but they limit the strings to a specific tuning relationship since they do not allow for variability between string tensions during play for the production of unique and aesthetically pleasing vibratos and other pitch variation effects.

Regardless of the vibrato mechanism design, many performers do not like vibrato devices because of two fundamental design problems. First, most of these vibrato devices require the performer to engage the vibrato device by hand. This restricts right hand picking techniques while also eliminating independent playing techniques by the right hand while the performer engages the device. The second problem is that the most vibrato devices use a common variable plate in combination with springs as the resiliency means for counteracting string tension and to maintain the variable plate in its nominal positioning. This design requires the performer to continually retune all of the strings until the retensioning force of the springs maintains each string's tension at the correct level for producing the desired frequencies.

With such an architecture, when one string goes out of tune, they all go out of tune to some extent. This is because each string's tension affects the positioning of the common variable plate and the tensioning/detensioning cycle of vibrato and pitch variation effect engagement with these vibrato devices, in combination with machine head slippage, and the variable resiliency of instrumental materials (including the springs) greatly escalates all the problems related to tuning an instrument and keeping it in tune during play. To many performers, the sound effect capabilities of a vibrato device are exceptionally beneficial to expression even with the present limitations of vibrato devices, but in consideration of all of the tuning difficulties related to initially tune the instrument and maintain it in tune during a performance due to the above stated problems, the additional expressive capabilities are not worth the additional tuning difficulties.

From the foregoing discussion, it can be appreciated that it is desirable to have a means for controlling string tension wherein the tensioning means is simple in construction, eliminates the inherent manual rotational adjustment and position slippage of machine heads and tuning pegs, provides for the automatic tuning of any combination of strings at any time and provides the means for producing a multiplicity of extremely beneficial frequency variation effects for an expansion in the expressive capabilities of the instrument and the performer engagable during both dependent and independent playing techniques.

SOLUTION

The above described problems are solved and a technical advance achieved in the art by the string tensioning apparatus for a string musical instrument of the present invention. The string tensioning apparatus includes a string tensioning device to provide the mechanical string tension control function and associated control electronics to regulate the operation of the string tensioning device. The string tensioning device includes a bidirectional motor as the mechanical means to vary, control and maintain string tension. The associated string is directly connected to the motor shaft, whose rotation is regulated by the associated control electronics. A transducer is used to measure the frequency of operation of each string. The measured frequency is then compared to a value stored in memory to produce an indication of the difference between the actual and desired frequency of operation. This difference is then used to control the direction and amount of rotation of the motor shaft to bring the string frequency of operation into compliance with the stored frequency value thus tuning the string.

The string tensioning device includes means that are easily engaged during dependent and independent play to produce and control vibratos and other pitch variation effects for the expansion of musical expression. This vibrato device independently controls each string's tension and rate of tension change relative to the other strings thereby providing the performer the capability of producing harmonically correct monophonic and polyphonic vibratos, standard pitch variation effects and a myriad of novel, unique and aesthetically pleasing vibrato and pitch variation effect possibilities never before available with any string instrument.

This apparatus eliminates the inherent and unpredictable position slippage that occurs with the use of machine heads and tuning pegs. The string tensioning device provides for easy string attachment, eliminates the problems associated with manual adjustment of string tensions, eliminates the necessity of having to tune the instrument aurally, automatically tunes any combination of strings depending upon the discretion of the performer and allows for an easy implementation of tuning variability in relation to other instruments, different tuning relationships and tuning standards.

These and other objects of the present invention are apparent to those skilled in the art from the following detailed description, showing the contemplated novel construction, combination, and elements as herein described, and more particularly defined by the claims, it being understood that changes in the precise embodiments of the disclosed invention are meant to be included as coming within the scope of the claims, except insofar as they may be precluded by the prior art.

DETAILED DESCRIPTION

Figure 1:
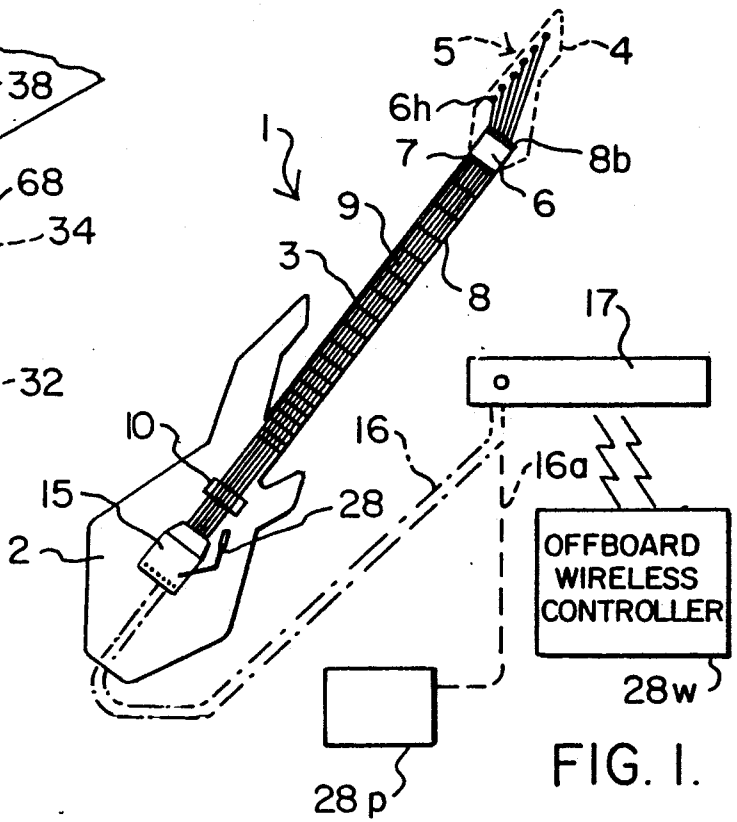
FIG. 1 illustrates a standard electric guitar 1 in combination with the string tensioning apparatus, its support electronics and a variety of engaging means.

Referring now to the drawings in more detail, the same numbers in each figure generally represent the same elements. FIG. 1 illustrates a perspective view of a string musical instrument such as an electric guitar 1 with body portion 2, neck 3, headstock 4, machine heads 5, string securing apparatus 6, nut 7, frets 8, strings 9, group pickups 10. The string tensioning apparatus of the present invention includes string tensioning device 15, support electronics 17, engaging arm 28, engaging pedal **28*p* and offboard wireless controller 28*w*. As can be seen, the present string tensioning device 15 is situated similar to standard vibrato devices and bridges found within the art. Support electronics 17** are typically contained within a rack mount enclosure.

Cable 16 provides power and information transfer between the string tensioning device 15 and its support electronics 17. Cable 16 is shown in phantom to indicate that wireless information transfer and control of the string tensioning device for greater player mobility is viable, with the inclusion of onboard power and the necessary frequency modulation means for the transmission and reception of data.

Engaging pedal **28*p* provides the capability for foot operated control of the string tensioning apparatus during both dependent and independent play with information transfer to support electronics 17 via cable 16*a*. The offboard wireless controller 28*w* is in essence a combination hand held/thumb engagable wireless joyball/-switch that provides the performer with the capability of engaging the string tensioning apparatus by hand without distraction from dependent or independent playing techniques. For simplicity, written and drawn references relative to the variable positioning capabilities provided by engaging arm 28 and device functions controlled therewith, also refers to engaging pedal 28*p* and offboard wireless controller 28*w*** until the specific explanation of these aspects of the present invention later in the discussion.

The headstock 4 is shown in phantom to illustrate that the present invention is viable with "headless" electric string instruments and that it eliminates the need for machine heads **6*h*, but is still adaptable to an existing instrument that include such devices. It is desirable to replace all machine heads 6*h* with a nonadjustable string securing means 6 attached to the headstock 4, such as a simple block with through holes 8*b* as is indicated by string securing apparatus 6, or at the very least, include the usage a string lockable nut 7 or another type of string securing device in adapting the string tensioning apparatus to instruments that presently include machine heads 6*h***.

Perspective views of String Tensioning Device

Figure 2:
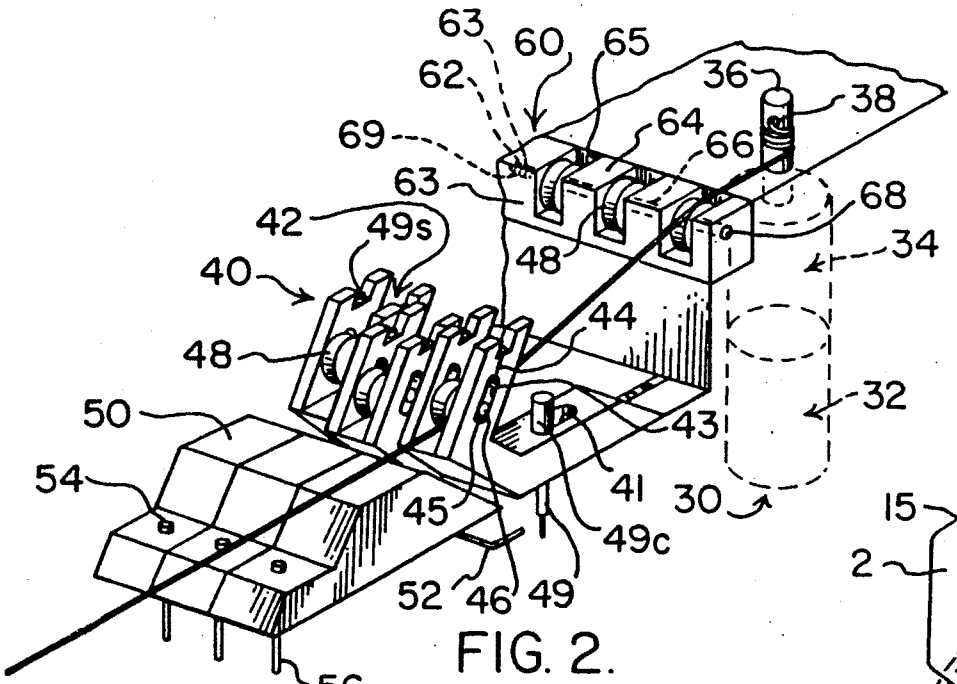
FIG. 2 is a fragmentary perspective view of part of the string tensioning device.
Figure 5:
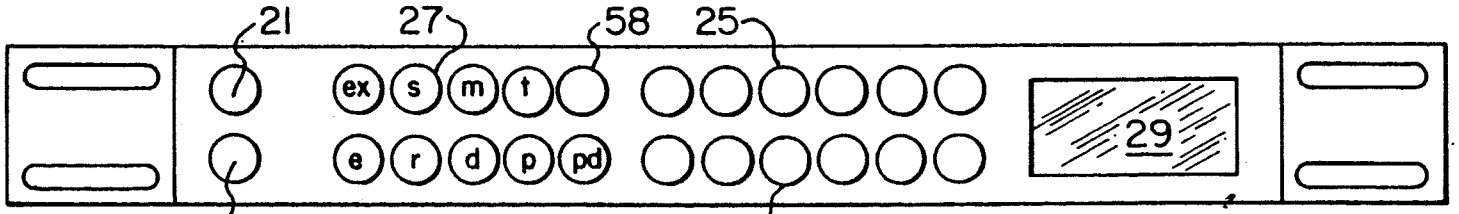
FIG. 5 is a front view illustration of the offboard electronics in a rack mount type of enclosure.
Figure 3:
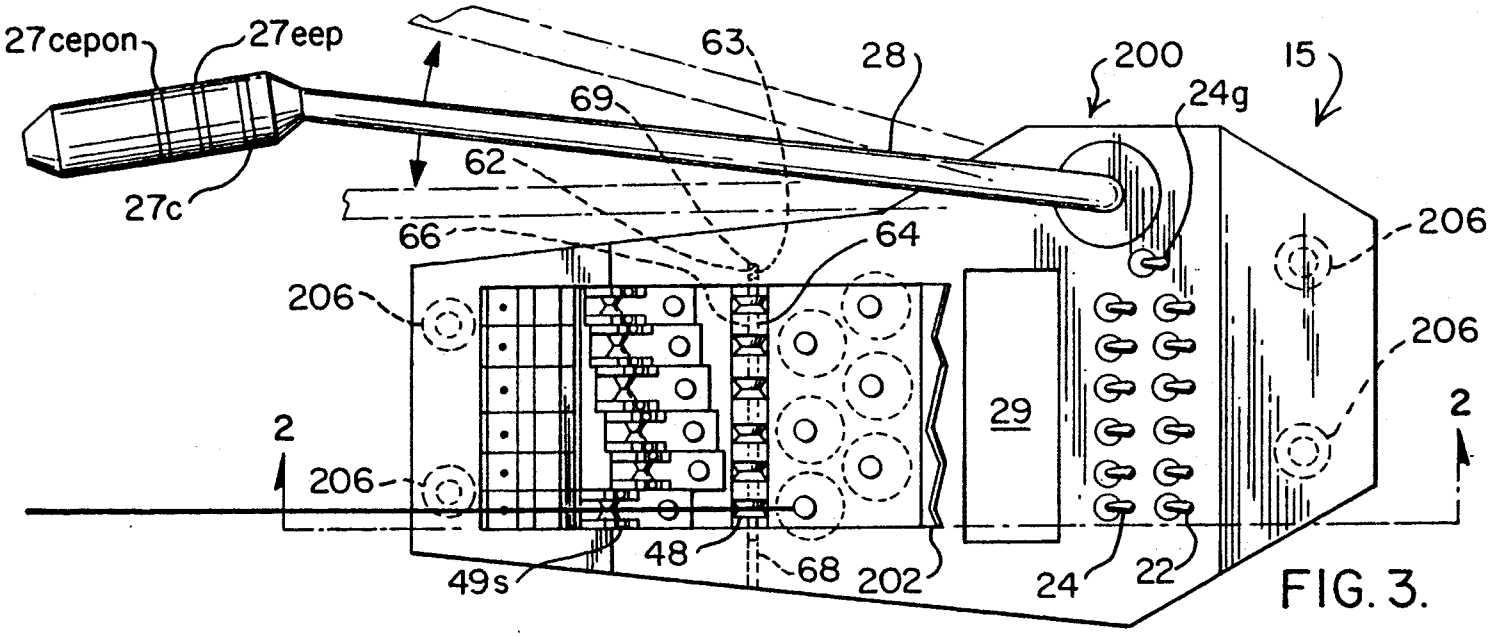
FIG. 3 is a top view of part of the string tensioning device.
Figure 4:
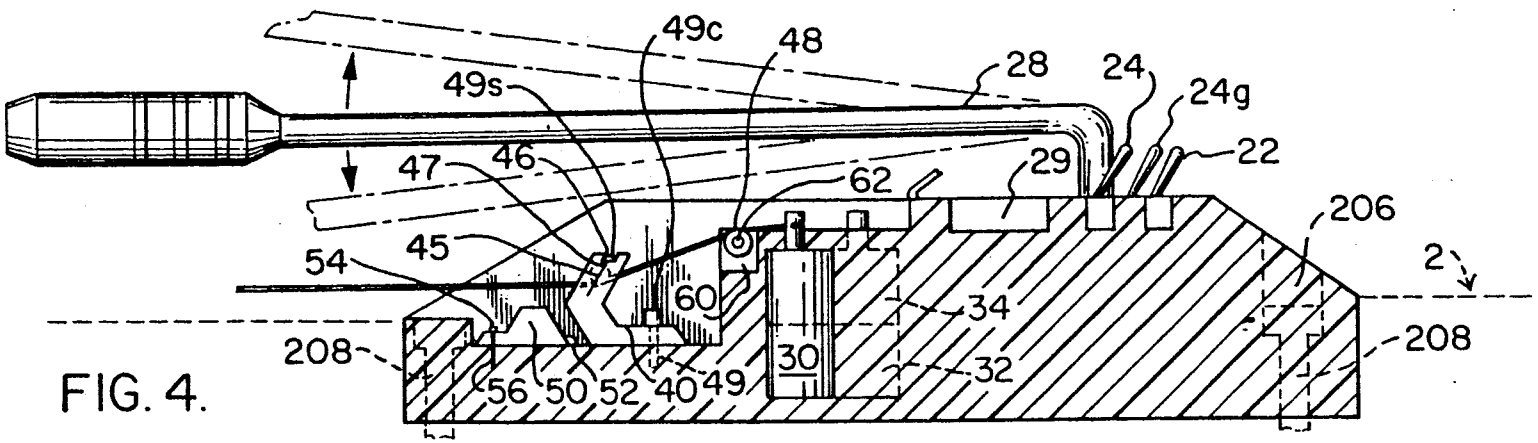
FIG. 4 is a side view of part of the string tensioning device.

FIGS. 2 through 4 illustrate the string tensioning device 15 for a lute-type instrument in partial perspective, top and side views respectively with FIG. 5 illustrating the front view of the housing and controls of the offboard support electronics 17. The main structure 200 of the string tensioning device 15 includes string tensioning device cover plate 202, which provides housing and support for engaging arm 28, the onboard device electronics (not shown), motors 30, bridge saddles 40, independent string transducers 50 and string guides 60 and threadably attaches to the body portion 2 via through holes 206 and bolts 208.

The string tensioning device 15 and its support electronics 17 include a diversity of discrete manually engagable means for function control. These include but are not limited to: device engagement combination selection button 21, switches 22 for motor activation during initial stringing, tune button 23 for frequency variability in relation to other tuning standards and instruments, tuning switches 24 for preference control of string tuning choices, frequency buttons 25 for adjusting string frequency choice, rate buttons 26 for adjusting the rate at which a string changes frequency of vibration during vibrato and pitch variation effect engagement, patch buttons/switches 27*d*, 27*e*, 27*ex*, 27*m*, 27*p*, 27*pd*, 27*r*, 27*s*, 27*t* for control of device engagement, and microprocessor access and potentiometers 28*x* and 28*y* of rotatably variable engaging arm 28 for manual control of specific device functions during play. Display units 29 provides the user with a visual status of the device's functions.

Motor

The present string tensioning apparatus relies on bidirectional motors 30 as the mechanical means to vary, control and maintain string tension. These motors come in a variety of formats and each is applicable to the present invention with the proper electronics and structuring. A.C. and D.C. motors are the most common devices found on the market. Stepper motors are devices that radically "step" the rotor a predetermined degree amount and direction each time a specific combination of control pulses are applied to the stator windings of the motor from the motor controller. These devices are used in situations that require programmable motion control and are the preferred motor type for the present string tensioning device.

Depending upon the type of instrument, motor size and weight may be a significant consideration. Litton Clifton Precision stepper motor #15-SHAL-32CZ is an example of small package stepper motor with small angle/high torque capabilities. If smaller space constraints are required, a smaller motor can be used in combination with a gearhead. A gearhead extends the torque capacity of the motor, reduces the step angle of the motor and enables the motor to operate at a higher rate relative to the output shaft of the gearhead. These devices are widely available on the market in a diversity of casing designs and gear reduction ratios. An example of one such gearmotor is a Litton Clifton Precision stepper motor #11 SPAA 256D in combination with a Precision Industrial Components gearhead #U7-9.

Depending upon the design requirements, the tensioning means may be either a motor 30, or as illustrated by the phantom line, a combination motor 32 and gearhead 34. Regardless of the design choice, each motor version includes an output shaft 36 and a string threading hole 38. With such a format, one of the greatest benefits is that attaching the string directly to the output shaft 36 via threading hole 38 provides for an infinite range of motion for string tension control. The prior art lever systems provide only an extremely limited range of motion for control of string tension and requires the use of machine heads to initially tension the strings up to the required levels while eliminating frequency variation effect capabilities.

When properly energized and operated, the string tensioning device 15 retains position integrity if the applied tension is below the holding torque capabilities of the associated motor 30. This eliminates the inherent position slippage of machine heads and all related tuning problems due to such slippage while providing for many other unique capabilities.

Bridge

Bridge saddles 40 include compensation slots 41, string slots 42, shaft slots 43, shaft slot through holes 44, shaft slot threadable holes 45, string shafts 46 with threadable holes 47 and string rollers 48. String rollers 48 provide for string guidance and friction relief and slip fit through shaft slots 43. String shafts 46 slip fit through string rollers 48 and through shaft slots 43. Adjustable string height is achieved via securing bolts 49*s* in combination with string shaft threadable holes 47, shaft slot through holes 44 and shaft slot threadable holes 45. Bridge saddles 40 attach to the main structure 200 via the slip fit of compensation bolts 49*c* through compensation slots 41 which find securable attachment via threadable holes 49. This allows for the necessary linear bridge saddle positioning variability required for correct string compensation.

Transducers

Independent string transducers 50 are individual string pickups that produce a separate electronic output for each string. These devices include physical outputs 52 and they attach to the main structure 200 via attaching bolts 54 and threadable securing holes 56. The main consideration with this aspect of the present invention is the production of independent string output signals. There are a wide range of available transducers including electromagnetic, optoelectronic and piezoelectronic devices that are applicable. Because of this, this aspect of the present invention is simply illustrative. It should be noted that the transducer may be contained within or supported by the structure of the bridge piece, but for simplicity, they are shown as being independent of each other. Also, by splitting the output from each independent string transducer 50 and using it in combination with the proper support electronics, these signals may be used for a multiplicity of purposes including synthesis interfacing. If the split signals are used for auditory applications, an inhibit of that signal prior to amplification is recommended while the present invention is functioning in the tuning mode so as to eliminate the sound of the strings being tuned. The preferred embodiment is to configure the split wherein when a string's tuning switch 24 is engaged into the on position, this concurrently disables the audio output signal of that specific string.

Depending upon the selected electronic process for the automatic tuning of strings, a group string transducer may be used in replacement of the independent string transducers 50. If both group and independent string transducers are required by the player for specific functions, one split off of each independent string transducer 50 may be applied to a summing amplifier for the production of a group string transducer output signal.

String Guides

String guide 60 is a combination of rod 62 with partial threading 63, alignment bridge 64 which includes alignment notches 65 and guidance holes 66, and string rollers 48. Alignment bridge 64 slip fits within the main structure 200. String rollers 48 slip fit within alignment notches 65. Securability of alignment bridge 64 and support of string rollers 48 within the main structure 200 is accomplished when rod 62 slip fits through guidance hole 68, alignment bridge guidance holes 66, string rollers 48 and is rotated to secure the partial threading 63 of rod 62 within thread hole 69.

Control Electronics Architecture

Figure 6:
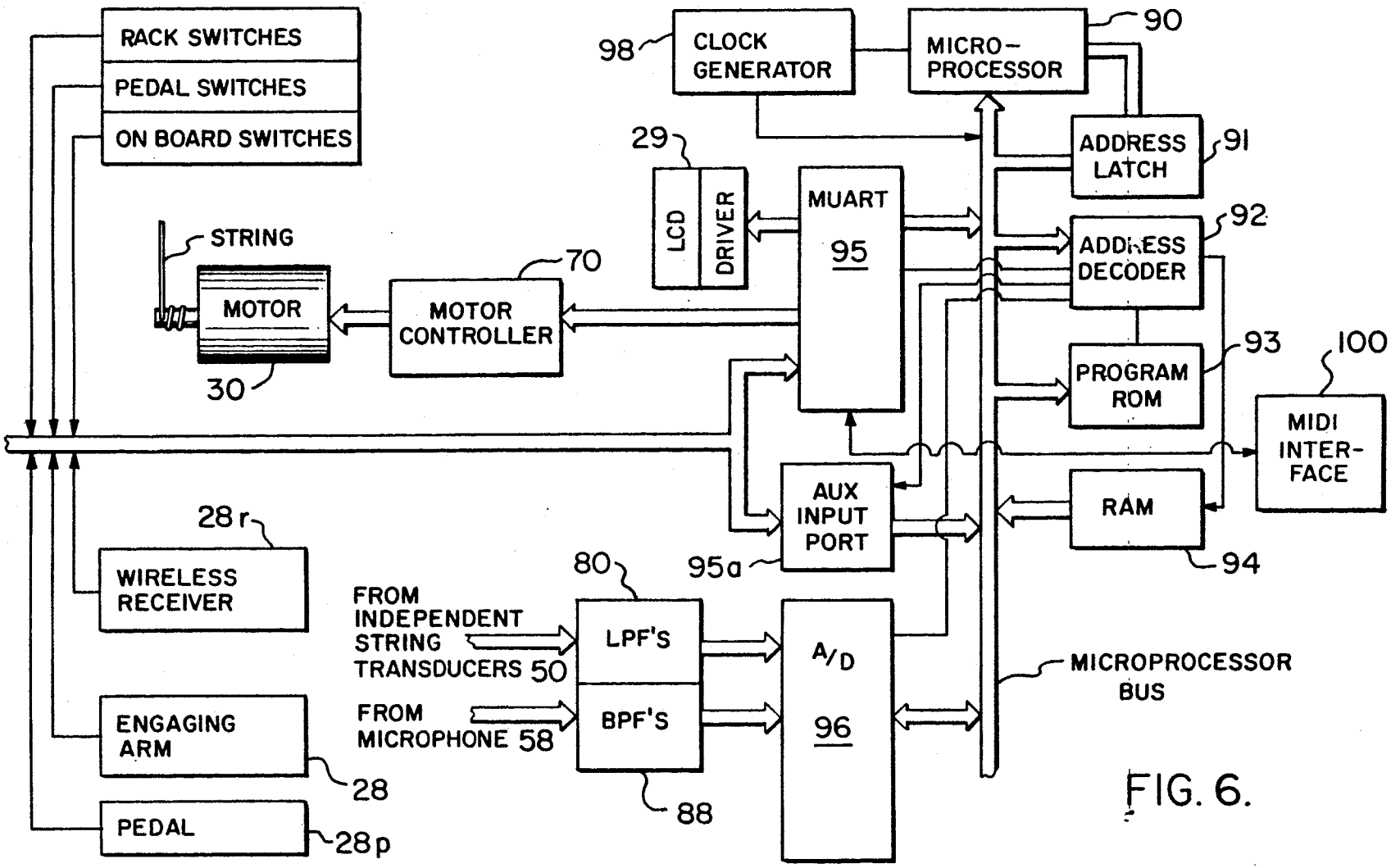
FIG. 6 is a block diagram illustrating the preferred embodiment of the control circuitry.

The block diagram in FIG. 6 illustrates the hardware components of the control electronics using a software controlled electronic format. Using a conventional design, microprocessor 90 is supported by address latch 91 and address decoder 92 which provide the means for controlling the flow of information to and from ROM 93, RAM 94, MUART 95, auxiliary input port 95*a*, A to D converter 96 and motor controller 70. Clock 98 provides the fundamental digital clocking pulses necessary to operate and synchronize the system. For simplicity, the combination input/output port of MUART 95 and auxiliary input port 95*a* is hereinafter referred to as MUART 95. It is to be expressly understood that this electronic diagram is an outline describing specific functional blocks. Many electronic components combine these functions on one chip in a variety of ways and therefore FIG. 6 is highly illustrative. Also, FIG. 6 illustrates only one motor 30 and one motor controller 70. In practice, the present invention may include a multiplicity of these devices depending upon the instrument, the requirements of the performer and the selected electronic devices, be it of a parallel or multiplexing format.

The input information to microprocessor 90 includes program instructions from ROM 93, information from RAM 94, control information via MUART 95, control signals from device engagement combination selection button 21, switches 22, tune button 23, independent string tuning switches 24, group tuning switch 24*g*, frequency buttons 25, rate buttons 26, patch buttons/-switches 27*d*, 27*e*, 27*ex*, 27*m*, 27*p*, 27*r*, 27*s*, 27*t*, potentiometers 28*x* and 28*y* of engaging arm 28 information from A to D converter 96 including data from each independent string transducer 50 via LPFs 80 and from microphone 58 via BPFs 98. Output information includes data for the display driver of display unit 29, control signals for the motor controller 70. Wireless receiver 28*r* simply provides for the reception of information from the transmitter of the offboard wireless controller 28*w*.

Initial String Tuning

Referring specifically now to the initial string attachment capabilities of the present invention, the player first threads a string 8 through one of the string holes 6*h* in string securing means 6 and pulls the string until its string ball 8*b* touches the securing face of string securing means 6. String securing means 6 is simply a block with a multiplicity of through holes attached to the instrument above the string nut 7. The performer now threads the string 8 over nut 7, under bridge string rollers 48, over the string rollers 48 of string guide 60 and through the threading hole 38 of the gearmotor's output shaft 36. Now the performer places the rotate switch 22 for that string's specific motor into the position for positive rotation. Microprocessor 90 receives this rotate command information via MUART 95. ROM 93 provides the program information for this function. Microprocessor 90 now produces a rotate control attaching signal that engages the motor controller 70 for that specific string which causes the output shaft 36 of that string's specific motor to slowly rotate which enables the performer to easily secure the string 8 as it wraps around the output shaft 36 and is pulled taut. Once the string 8 is secure, the performer disengages the rotation of the output shaft 36 by simply placing the rotate switch 22 into its off position which signals the microprocessor 90 to cease this function. This capability provides for exceptional ease in attaching new strings and stabilizing their resiliencies by eliminating the inherent manual rotation necessary with machine heads and tuning pegs. If the performer places rotate switch 22 into its position for negative rotation, string tension is decreased. With the capability for both positive and negative rotational control over output shaft 36, this system also provides the player with the means for manually adjusting string tensions for aural tuning if so desired.

Automated String Tuning

The next aspect of the present invention provides for automatic string tuning with player discretion for variability in string tuning combinations, reference frequency standards and tuning relationships. The discussion of this aspect of the present invention refers to using a fast Fourier Transform (FFT) in combination with independent string transducers as the means for determining the fundamental frequency of a vibrating string, but it is to be expressly understood that this is only one of the many possible electronic formats for providing this function.

For automatic string tuning, the performer first pulls up a tuning patch by pressing patch button 27*t* until the tuning patch of choice appears on display unit 29. When it does, the performer releases patch button 27*t* while this tuning patch is being displayed on display unit 29. Each tuning patch is a preselection of digital numbers that correspond to the desired string frequency relationships be they for mean tone, 12 tone equal temperament, just intonation, open chords or any of the many possible tuning relationships. Now, the performer places the tuning switch 24 for each string to be tuned into its on position and causes the selected strings to be tuned to vibrate freely along the entire string length between the nut and bridge fulcrum points.

Each string's independent string transducer 50 correspondingly produces an analog signal indicative of that string's vibrations. This analog signal is first processed through the low pass filter (LPF) 80 for that specific string to eliminate the string's composite harmonic content. The output of LPF 80 then feeds into that string's corresponding input pin of A to D converter 96. Within A to D converter 96, the analog signal is converted into its digital equivalent. This digital value then feeds into microprocessor 90 via the microprocessor bus where each string's fundamental frequency is determined using the FFT and this value is then compared to the preselected digital number from RAM 94 that corresponds to the desired open string frequency for that specific string in that specific tuning patch.

Any discrepancy between the two numbers produces output clock signals at a specific rate and either a clockwise or counterclockwise rotate control signal from microprocessor 90 which drives the string's specific motor controller 70 via MUART 95 which correspondingly rotates the output shaft 36 of that string's motor 30 the correct direction and therefore adjusts that string's tension until it is correct for producing the desired vibrational frequency. When display unit 29 provides the visual indication that the string is in tune, the player switches that string's tuning switch 24 back into its off position. During the tuning function, each string that is engaged for tuning is sequentially scanned and processed a multiplicity of times to ensure the proper string tensioning while enabling the player to engage any combination of tuning switches 24 and concurrently tune those specifically chosen strings using a multiplex format thus allowing for complete performer preference in string tuning combinations from one string only to all of the strings. For simplicity, engaging tuning switch 24*g* into its on position overrides all of the individual tuning switches 24 thus enabling the performer to tune all of the strings at one time without having to separately engage each of the individual tuning switches 24 into their respective on positions.

Preset Tuning Patches

To preset a tuning patch, the performer first presses patch button 27*t* until the basic tuning patch for the instrument's standard tuning relationship or any other patch of choice appears. Now, the performer rotates each string's tuning button 25 from its off-hold position into either its positive-scan or negative-scan position until the new frequency of choice for that string appears on display unit 29. When it does, the performer switches patch button 25 back into its off-hold position. Each string's new frequency selection alters the string reference frequencies of that specific patch within the RAM 94. Once all selections are made, the performer tunes the instrument as described above. If recall of this patch is desired, pressing patch buttons 27*m* and 27*t* simultaneously places this new patch into RAM 94. If deletion of a specific tuning patch from RAM 94 is required, the performer need only press patch buttons 27*d* and 27*t* simultaneously while that patch is being shown on display unit 29. This deleted tuning patch is replaced with the basic tuning patch.

For variability to different standard tuning reference frequencies and other instruments that are slightly mistuned off of these standard tuning reference frequencies, the performer need only switch the multiposition tune button 23 into either the position for the standard reference frequency of A 440, the position for automatic reference frequency scan or the positive-scan or negative-scan positions for manual reference frequency selections. With the selection of the standard reference frequency position, all of the tuning patch frequencies are relative to the preset frequency standard of A 440.

Selecting the automatic reference frequency scan position causes microphone 58 within offboard electronics 17 to be turned on. The performer now produces an "A" on the instrument that is tuned slightly off of the standard reference frequency. The signal picked up from microphone 58 of this "A" is split and applied to a multiplicity of band pass filters 88 which are each selected for a specific octave range of the pitch A. This enables the present invention to tune to all other instruments regardless of the frequency ranges of the other instruments. Depending upon the octave range of the "A" produced, the band pass filter for that octave range passes the corresponding "A" without its harmonic content. This signal then feeds into the microphone input pin of A to D converter 96 and processed using a FFT to determine frequency of this mistuned "A".

When display unit 29 indicates that this new reference frequency has been determined, the performer switches tune button 23 into its external reference hold position to replace the tuning patch's present reference frequency number of A 440 with the new reference frequency number and correspondingly, all of the tuning patch frequency numbers of all of the patches within the RAM 94 are altered relative to this new reference frequency number via microprocessor 90 and the program information from ROM 93. Instrumental tuning now follows the process as described above. It should be noted that the electronic process for determining the frequency of the new reference frequency may use one of the other processes as described above for determining the fundamental frequency of a string for automatic tuning.

By switching tune button 23 into either its positive-scan or negative-scan position for manual reference frequency control, the reference frequency shown on display unit 29 slowly increases or decreases. When the reference frequency of choice appears on display unit 29, the performer switches tune button 23 into its manual reference hold position. This new reference frequency number correspondingly alters all of the tuning patch frequency parameters of all of the tuning patches within RAM 94 relative to this new reference frequency of choice via microprocessor 90 and program instructions from the ROM 93. Tuning the instrument is now done using the process described above. This simple system enables the performer to easily adjust all string frequencies relative to the standard reference frequency, to instruments that are slightly off of the standard tuning frequency without the necessity for aural comparison and to easily adjust for new standard frequencies.

Vibrato Control

The final aspect of the present string tensioning apparatus is to provide the performer with a tensioning apparatus capable of producing harmonically correct monophonic and polyphonic vibratos, standard pitch variation effects and a myriad of novel, unique and aesthetically pleasing vibrato and pitch variation effects for a vast expansion in musical expression via programmable motion control. When the present string tensioning apparatus is functioning either in the effect or continual mode of operation, each effect patch provides the means for a great diversity of frequency variation capabilities. Each effect patch pulled up from RAM 94 individually controls the rate, direction and distance of travel for each string's motor 32 and output shaft 36 and therefore string tension via the effect control signals from microprocessor 90 to the motor controller 70. The engagement of these frequency variation capabilities during play is via the multiposition rotary patch switch 27*c*, the multiposition rotary patch switch 27*eep*, the multiposition rotary patch switch 27*cepon*, patch switch 27*pd* and engaging arm 28, engaging pedal 28*p* and offboard wireless controller 28*w*.

Figure 7:
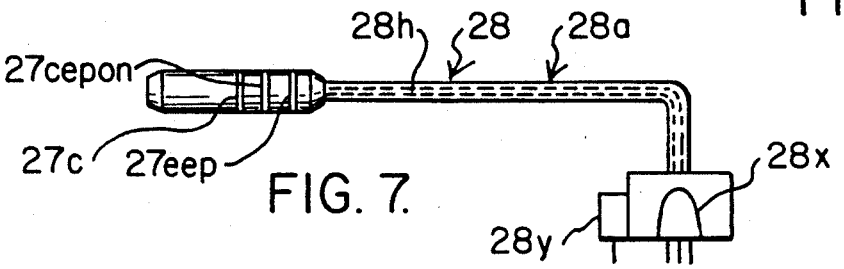
FIG. 7 is a partial side view illustration of the string tensioning device's onboard means for device engagement.

As FIG. 7 illustrates, engaging arm 28 is in essence a uniquely shaped joystick with nominal position return capabilities. Engaging arm 28 simulates the structure of a standard vibrato arm. For motion information, engaging arm 28 includes longitudinal and latitudinal axis mounted potentiometers, 28*y* and 28*x* respectively. Because of the many design variations possible with this unit, it is highly illustrative. It should be noted that the preferred embodiment limits the free rotational plainer movement of the engaging arm shaft 28 to approximately 150 degrees to minimize twisting on the wires from patch switches 27*c*, 27*cepon* and 27*eep* that run through the hollow channel 28h within engaging arm shaft 28a when the player rotates the engaging arm shaft 28a into and out of the standard vibrato arm engagement positions. Usable potentiometer designs for the present invention include standard trimmers and stepped attenuators. As is well known throughout the art, dual and quad axis joysticks provide for a multiplicity of output mixture combinations. With the present invention, potentiometers 28x and 28y provide motion information to the microprocessor 90 via A to D converter 96. The nominal position return capabilities of engaging arm 28 provides for center position retension, center position return and simulates the feel of standard vibrato arms presently on the market. Display unit 29 provides visual status when engaging arm 28 is in its nominal position.

While functioning in the effect mode, potentiometer 28y is effectively disconnected with all control information coming from potentiometer 28x. This in no way limits the positions in which the performer may displace engaging arm shaft 28a, it only eliminates unnecessary position information. While functioning in the continual mode, potentiometer 28y provides position and control information relative to the amount of frequency change and correspondingly, potentiometer 28x provides position and control information relative to the rate of frequency change. When engaging arm shaft 28a is in its neutral position, the present invention will function relative to the continual presets. Displacement of engaging arm shaft 28a from its neutral position will correspondingly alter the amount of frequency change and the rate of frequency change during the continual function depending upon the displaced position of engaging arm shaft 28a providing for a myriad of unique sonic capabilities. It should be noted that analog potentiometers are only a few of the means capable for providing the microprocessor 90 with the motion information from engaging arm 28. High resolution digital contacting and optical encoders are two examples of digital devices capable of providing this function for the string tensioning apparatus and provide for direct microprocessor input capabilities without the necessity of A to D conversion as is required with analog pots.

Rotary patch switches 27c and 27cepon located on the distal end of engaging arm shaft 28a enable the performer to engage the continual function of an effect patch during play. Patch switch 27c includes a multiplicity of position settings which enable the performer to select which excursion presets of the effect patch are used during the continual function. The first choice is for alternating reproduction the presets of the preselected individual positive and negative excursions. The second is for repetition of the chosen individual positive excursion only. The third is for repetition of the chosen individual negative excursion only. The fourth is for the sequential repetition of all of the positive excursions contained within the effect patch. The fifth is for sequential repetition of all of the negative excursions. Finally, the sixth choice is for the sequential and alternating repetition of all of the positive and negative excursions contained within the effect patch. During play, the performer first selects which excursion presets of the patch are to be used during the continual function via patch switch 27c. Then, when engagement of the continual function is desired, the performer switches patch switch 27cepon into its continual on position.

The location of patch switches 27c, 27cepon and 27eep towards the free end of engaging arm shaft 28a provides the performer with quick and easy access of the present invention's capabilities during play. The preferred embodiment for the knobs of these switches are of a knurled type. By wrapping and rotating the little finger around the switch of choice on the free end of engaging arm shaft 28a, the switch position is easily altered. This simple technique enables the performer to easily engage the present invention without any distraction from string picking. For example, with patch switch 27c in any preselected excursion choice position and with patch switch 27cepon in its off position, the performer may displace engaging arm shaft 28a to any position and then engage the continual function by placing patch switch 27cepon into its continual on position. With this, the amount and the rate of frequency change in relation to the continual presets are alterable prior to engaging the continual function. This enables the performer to engage the continual function using the amount and the rate of frequency change settings as determined by the displaced position of engaging arm shaft 28a in relation to the continual presets.

Engaging pedal 28p is a foot controlled version of engaging arm 28 wherein engaging arm shaft 28a is modified to receive a foot pedal. With engaging pedal 28p, the performer may control the present invention by foot using displacement motions similar to engaging arm shaft 28a . Engaging pedal 28p also includes nominal position return capabilities when the performer releases the pedal. The function of engaging pedal 28p is to provide the performer with the capability of controlling the present invention while using dependent and independent play string techniques. To engage the device while in the effect mode, the performer simply displaces the engaging pedal 28p. To engage the device for the continual function, the pedal includes a pressure pad (not shown) that replaces the continual on setting of patch switch 27cepon wherein the performer must apply a certain amount of pressure to engage the continual function.

With this, the performer must displace engaging pedal 28p to the desired position, press down on the pressure pad thus engaging the continual function, control device capabilities via foot control of the positioning of engaging pedal 28p using displacement motions similar to engaging arm shaft 28a and then press down again on the pressure pad 27pd to disengage the continual function. A replicant bank of push button switches that correspond to tuning switches 24 and a replicant bank of rotary switches that correspond to patch switches 27c, 27cepon and 27eep are included within the bulk structuring of the pedal housing of the engaging pedal 28p to enable the performer to engage all the necessary device functions during play without distraction during certain playing techniques with usage as determined by the patch selection setting of device engagement combination selection button 21. Device engagement combination selection button 21 will be discussed in detail later in the discussion.

Wireless Controller

In reference to the offboard wireless controller 28w , this device is another means for providing the performer with the capability of engaging the present invention during dependent and independent playing techniques. It is in effect, a wireless handheld version of engaging arm 28 that is engaged by the thumb and includes nominal position return capabilities when disengaged by the performer. A miniature joyball (not shown) is the preferred means of providing for this function and is easily positionable by the thumb into configurations that correspond to the positionings of engaging arm shaft 28*a* . The joyball also includes a pressure pad 27*w* that replaces the continual on setting of patch switch 27*cepon* for continual function engagement and is implemented similar to an engaging pedal 28*p* as described above.

This device also includes miniature push button to enable the performer to positively sequence through the effect patches or through the effect patches within an effect patch progression without the necessity of requiring the performer to engage patch switch 27*eep* . This capability is dependent upon the setting of a specific patch's device engagement combination selection button 21 is discussed shortly. This enables the performer to engage the device without distraction from independent playing techniques while eliminating the necessity of having to engage the device with the engaging pedal 28*p* during independent play. This greatly increases the performer's stage mobility during device engagement while also providing the performer with another means for device engagement during independent play.

Vibrato Effects

With standard vibrato devices, displacing the vibrato arm towards the surface of the instrument causes all string tensions to decrease while motion away from the surface of the instrument causes all string tensions to increase. With the basic displacement technique of such devices, the performer flowingly displaces the device's vibrato arm at a controlled rate from its neutral position to a specific displacement destiny and then returns it back to its neutral position. Such motion produces one complete excursion of tension variation. A negative excursion exists when the performer flowingly displaces the vibrato arm away from its neutral position to a specific displacement destiny towards the instrument's surface and then returns the vibrato arm back to its neutral position. A positive excursion exists when the performer flowingly displaces the vibrato arm away from its neutral position to a specific displacement destiny away from the instrument's surface to increase string frequencies and then returns the vibrato arm back to its neutral position.

Figure 8:
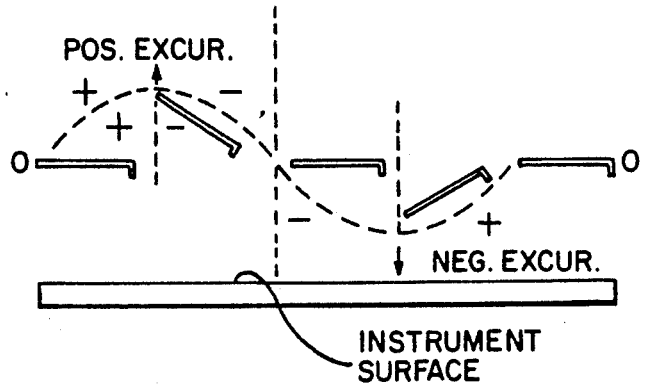
FIG. 8 is a fragmentary side view that illustrates one complete motion cycle of the string tensioning device onboard means of device engagement relative to the surface of the instrument and the corresponding positive and negative travel of the positive and negative excursion choice selections contained therewith.

Because each complete excursion of tension variation includes both positive and negative changes in string tension, determination of excursion type is dependent upon the displacement destiny of the vibrato arm. FIG. 8 shows the correlation between a simple sine wave and a complete cycle of displacement motion of engaging arm shaft 28*a* relative to the surface of the instrument for vibratos. This motion includes both a positive and a negative excursion and the corresponding positive and negative travel of each excursion in relation to the surface of the instrument's body portion 2. With each patch, the player may edit together a multiplicity of these excursion blocks providing for the unique capabilities of this aspect of the present invention.

To set an effect patch for performer discretion in tensioning variation control, the performer first presses device engagement combination selection button 21 until display unit 29 indicates that all onboard devices are controlling the present inventions functions as is discussed shortly. The performer then selects either a blank effect patch with no chosen presets, or any other effect patch of choice by placing patch switch 27*eep* into either its positive or negative effect patch scan position. When the patch of choice appears upon display unit 29, the performer places patch switch 27*eep* back into its effect patch hold position. Now, to create a new patch using a blank effect patch, the performer first switches patch button 27*cepon* into the effect patch memory/delete position and presses patch button 27*s* to initiate the sequence for patch variations. Next the performer selects either a positive or negative excursion by placing patch switch 27*ex* in either its positive or negative excursion choice position.

With the selection of a positive excursion, the first presets are for the string frequency variations during the positive travel of the first positive excursion wherein engaging arm shaft 28*a* is displaced away from its neutral position and the surface of the instrument. Switching the frequency button 25 for a specific string from its off-scan position into either its positive-scan or negative-scan position cause the frequency preset for that string to slowly change positively or negatively in relation to its frequency preset for the neutral position of engaging arm shaft 28*a* to the frequency of choice relative to a full positive displacement of engaging arm shaft 28*a* away from its neutral position.

With this, for example, if the performer selects a negative frequency preset for a specific string in relation to the positive travel of this first positive excursion, when the performer displaces engaging arm shaft 28*a* positively during the positive travel of this first positive excursion choice, that selected string decreases in frequency. Once the frequency of choice is reached for the full positive displacement of engaging arm shaft 28*a*, the performer switches the frequency button 25 back to its off-scan position. If the frequency preset for the neutral position of engaging arm shaft 28*a* and the frequency preset for a full displacement of engaging arm shaft 28*a* are maintained at the same frequency for a specific string, no change in frequency occurs for that string when engaging arm shaft 28*a* is displaced. With this, the performer repeats this process for each string until the frequency changes are set for each string during the positive travel of this first positive excursion. All frequency change presets are, in effect, the preset number of pulses applied to each string's stepper motor that produce that corresponding change in string frequency.

Rate of Change Control

Now the performer selects the rate of change for each string during the positive travel of this first positive excursion choice via rate buttons 26. Switching the rate button 26 for a specific string from its off-scan position into either its positive-scan or negative-scan position slowly increases or decreases the rate at which that string's tension changes relative to the displacement rate of motion of engaging arm shaft 28*a*. When the desired rate of change for that string is achieved, the performer switches that string's rate button 26 back into its off-scan position. The performer repeats this for every string until all rate selections for every string are set during the positive travel of this first positive excursion. Each rate of change preset for a specific string sets the clock rate at which the preset number of frequency change pulses for that string's stepper motor 30 are sent relative to the motion information from engaging arm shaft 28*a*. The rate of change function is dependent upon the frequency change presets for the strings in that there must be a frequency change preset relative to the displacement of engaging arm shaft 28*a* away from its neutral position for the rate of frequency change to occur. If there is no frequency change preset relative to the displacement motion of engaging arm shaft 28*a* away from its neutral position, there is no rate of frequency change because there is no change in frequency when engaging arm shaft 28*a* is displaced.

Once each string's settings for frequency change and rate of change are selected for the positive travel of this first positive excursion, the performer now sets the continual rate for the positive travel of the first positive excursion via patch button 27*r*. The continual feature of the present invention provides the performer with the means for producing vibratos and other pitch variation effects at rates, durations and consistencies far beyond the manual capabilities of the performer by eliminating the necessity of having to manually displace engaging arm shaft 28*a* the correct distance, at the correct rate and for the desired duration while providing for real time control over the amount and rate of frequency change of the strings relative to the preset relationships within the effect patch via microprocessor control over the motors 30 when the present invention is functioning in the continual mode. In effect, this function is the electronic substitute of engaging arm 28.

Rotation of patch button 27*r* into either its positive-scan or negative-scan position slowly increases or decreases the clock rate at which the presets for the positive travel of the first positive excursion is repeated when the present invention is engaged to function in the continual mode. Display unit 29 provides for visual status of the predetermined rate of continual change via a flashing cursor. This feature enables the performer to use the visual display information to preset the continual rate and also to use it as a metronome to initially set the tempo of the song ensuring that when the string tensioning apparatus is engaged for this function, it is rhythmically synchronized with the music being performed. Once the rate is selected for this part of the excursion, the performer switches patch button 27*r* back into its off-hold position.

Now that all selections are made for the positive travel of the first positive excursion, the performer presses patch button 27*s* at this time to store the settings for the positive travel of the first positive excursion and to correspondingly sequence the present invention into the presetting procedure for the negative travel of the first positive excursion. The performer now selects the frequency, rate and continual changes during the negative travel of this first positive excursion using the process described above. Pressing patch button 27*s* again saves this information and sequences the present invention into the presetting procedure for the next excursion. If, for example, the next excursion choice is for a negative excursion, the performer first places patch switch 27*ex* into the position for a negative excursion choice and then selects the frequency and rate changes for each string and the continual rate during the negative travel of this first negative excursion using the process described above. Again the performer presses patch button 27*s* to save all prior patch information and sequence the present invention into the presetting procedure for the positive travel of this first negative excursion. Now, the performer selects the frequency, rate and continual changes during the positive travel of the first negative excursion. Once these settings are complete, the performer presses patch button 27*s* again to save the patch information.

Figure 9:
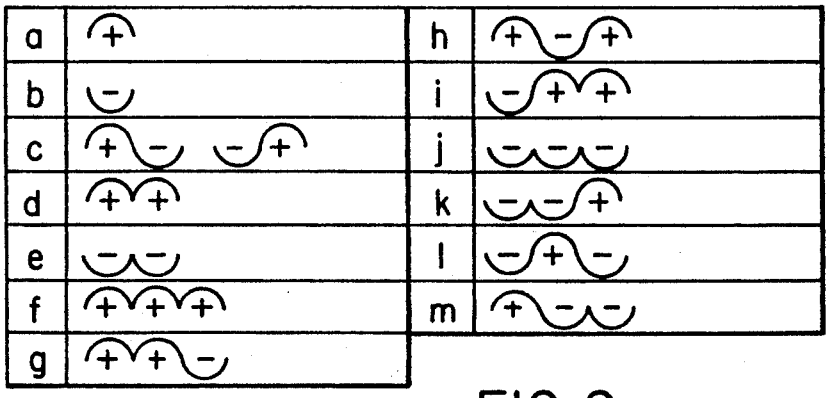
FIG. 9 is a chart which illustrates a few of the programmable patch excursion choice selections possible using a software based format for the string tensioning apparatus.

It should be noted that the performer may displace engaging arm shaft 28*a* anywhere from a full displacement to any partial displacement amount. The amount of displacement alters the frequency range of the strings depending upon the amount of displacement of engaging arm shaft 28*a* relative to the frequency range presets of the effect patch for the full displacement of engaging arm shaft 28*a*. Regardless of the displacement amount, when engaging arm shaft 28*a* is returned to its nominal positioning, the device will sequence into the next excursions presets. If the patch contains only one positive, one negative or one positive and one negative excursion, each time engaging arm shaft 28*a* is displaced for that specific excursion type, the relationships for that excursion are repeated. The performer may also continue to add excursions by following the above sequences until the desired excursion progression exists. FIG. 9 illustrates a diversity of a few simple effect progression excursion waves. These include:

(a) positive only;
(b) negative only;
(c) positive/negative;
(d) positive/positive;
(e) negative/negative;
(f) positive/positive/positive;
(g) positive/positive/negative;
(h) positive/negative/positive;
(i) negative/positive/positive;
(j) negative/negative/negative;
(k) negative/negative/positive;
(l) negative/positive/negative and
(m) positive/negative/negative.

The possible excursion wave combinations increases exponentially relative to the number of excursion choices selected. Each time engaging arm shaft 28*a* is displaced for a specific excursion type regardless of the depth of the excursion and returned to its nominal positioning, the relationship information of the patch changes sequentially relative to the motion of engaging arm shaft 28*a*. For example, the third negative excursion of engaging arm shaft 28*a* change string frequencies relative to the presets of the third negative excursion of that specific effect patch if engaging arm shaft 28*a* has been displaced and returned to its nominal position twice. Once the entire progression is played through, it repeats itself.

Continual Function

In relation to the continual function, the performer may preselect which excursions or excursion sequences are the control data for the continual function. For positive only continuals, by placing patch switch 27*c* into the position for positive excursion choices, the string tensioning apparatus slowly scans through the positive excursion choices. When the excursion of choice appears on display unit 29, the performer presses patch button 27*s* to save this first positive continual excursion choice. The performer may continue to add positive continual excursion choices, up to the entire number of positive excursions contained within the patch, by pressing patch button 27*s* when that excursion number is displayed.

For negative only continuals, by placing patch switch 27*c* into the position for negative excursion choices, the string tensioning apparatus slowly scans through the negative excursion choices. When the excursion of choice appears on display unit 29, the performer presses patch button 27*s* to save this first negative continual excursion choice. The performer may continue to add negative continual excursion choices, up to the entire number of negative excursions contained within the patch, by pressing patch button 27*s* each time that excursion number is displayed. Placing patch switch 27*c* back into its off position discontinues the excursion choice scanning. For combination positive and negative continual excursion sequences, the performer sequentially selects and saves the excursion choices in the sequence desired.

If the performer needs to go back into the effect patch to change some of the presets, pressing patch button 27*e* with patch switch 27*cepon* in its effect patch memory/-delete position while that patch is being shown on display unit 29, causes the present invention to sequentially step through the positive and negative travel presets of each excursion choice and the presets for the continual function. When the desired section appears, the performer releases patch button 27*e*. At this point, the performer may alter the presets as desired using the processes described above. The player may repeat this process as many times as necessary to achieve the desired patch parameters.

To save this new effect patch, the performer need only press patch button 27*m* of any time regardless of which excursion choice is being displayed. To delete this patch before it is saved, pressing patch button 27*d* while patch switch 27*cepon* is in its effect patch memory/delete position dumps this patch from RAM 94. To delete any saved effect patch, the performer need only place patch switch 27*eep* into either its positive or negative patch scan position until the desired effect patch is shown on display unit 29. When the desired patch for deletion appears upon display unit 29, the performer places patch switch 27*eep* into its patch hold position. At this point, the performer places patch switch 27*cepon* into its effect patch memory/delete position and presses patch button 27*d*. This dumps this patch's presets from RAM 94 leaving the basic effect patch in its place.

Patch Progressions

With such effect patch capabilities, the performer may design a specific effect patch to quickly retune string tensions to a new tuning relationship by simply displacing engaging arm shaft 28*a* a specific distance and direction from its neutral position and then returning it back to its neutral position. Another feature of the string tensioning apparatus enables the performer to set and recall a multiplicity of specific effect patch progressions. Each effect patch progression enables the performer to sequence together a multiplicity of effect patches for easy recall during play relative to a specific song, song list or an entire performance. To save a specific progression of effect patches, the performer first selects which effect patch progression choice is to be used by switching patch button 27*eep* from its effect patch selection hold position into either its positive or negative progression scan position.

When the desired progression choice appears on display unit 29, the performer returns patch button 27*eep* back into its effect patch progression selection hold position. Now, the performer places patch switch 27*cepon* into its effect progression memory/delete position. Next, the performer selects and holds the first patch of choice for the progression using the patch choice scan process described above. Now, by pressing patch buttons 27*s* and 27*m* simultaneously, the first patch of the progression is saved. The performer continues to scan, hold and save effect patches until all of the patches for the progression have been chosen. If an effect patch needs to be deleted from the progression, the performer presses patch button 27*s* until the effect patch to be deleted appears on display unit 29. When it does, the performer releases patch button 27*s* to hold the patch and then simultaneously presses patch buttons 27*s* and 27*d* to delete the patch from the progression.

To save this new progression, the performer simply presses patch button 27*m*. To delete this or any other effect patch progression, the performer places patch switch 27*cepon* into its effect progression memory/-delete position and presses patch button 27*d* while that specific effect patch progression is being shown on display unit 29. To sequence through the effect patches within that specific effect patch progression, the performer simply switches patch switch 27*eep* from its effect patch progression selection-hold position into either its positive effect patch progression-scan or negative effect patch progression-scan position until the effect patch of choice within the progression appears on display unit 29. The performer then returns patch switch 27*eep* back into its effect patch progression selection-hold position and the presets of this new patch will control the present invention's functions. If the performer needs to escape the progression and resequence it from the beginning during play, placing patch switch 27*eep* into its effect patch progression resequence position and then returning it to its effect patch progression selection-hold position accomplishes this function.

For manual engagement of an effect patch's capabilities during play using engaging arm shaft 28*a*, patch switch 27*eep* must be either in its effect patch selections-hold position or in its effect patch progression selection-hold position and patch switch 27*cepon* must be in its engaging means effect on position for the present invention to function relative to the presets of the effect patch when engaging arm shaft 28*a* is displaced. By placing patch switch 27*cepon* in its off position, its effect memory/delete position or its continual memory/delete position, potentiometers 28*x* and 28*y* of engaging arm 28 are effectively disconnected. If however, patch switch 27*cepon* is placed into its continual on position and patch switch 27*c* is in any of its continual engagement positions, potentiometers 28*x* and 28*y* of engaging arm 28 provide information for real time control over the amount and the rate of frequency change relative to the effect patch's continual presets via engaging arm shaft 28*a* while the string tensioning apparatus functioning in the continual mode discussed above.

Figure 10:
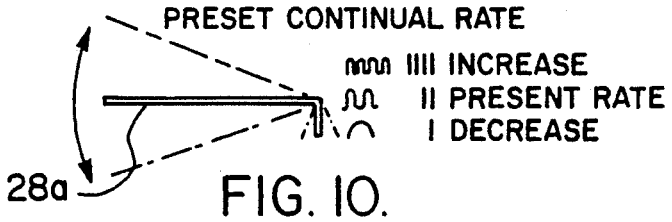
FIG. 10 is a fragmentary side view of the onboard means of engagement which illustrates how latitudinal displacement of the onboard means of engagement away from its nominal position alters the continual rate of the present invention while functioning in the continual mode of operation.

With the string tensioning apparatus functioning in the continual mode and in reference to the real time performance control over the rate of frequency change, FIG. 10 is a side view of engaging arm shaft 28*a* that illustrates how displacement of engaging arm shaft 28*a* towards the surface of the instrument reduces the overall preset continual rate of change of the strings while maintaining the relative pitch relationships between the strings, that displacement of engaging arm shaft 28*a* away from the surface of the instrument increases the overall preset continual rate of change of the strings while maintaining the relative pitch relationships between the strings and that with engaging arm shaft 28*a* in its neutral position, the continual rate of change of the strings is functioning at the preset rate of continual change and at the preset relative pitch relationships.

Figure 11:
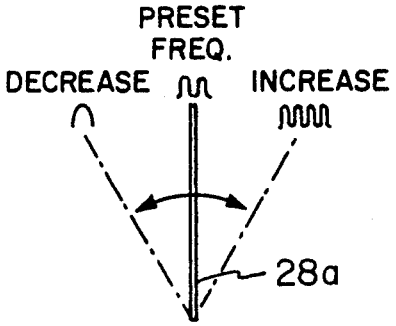
FIG. 11 is a fragmentary end view of the present invention's onboard means of engagement which illustrates how longitudinal displacement of the present invention's onboard means of engagement away from its nominal position alters the frequency range of the present invention while functioning in the continual mode of operation.

FIG. 11 is an end view of engaging arm shaft 28*a* and illustrates that counterclockwise displacement of engaging arm shaft 28*a* reduces the amount of each string's preset frequency change while maintaining the relative pitch relationships between the strings and the preset rate of continual change, that clockwise displacement of engaging arm shaft 28*a* increases the amount of each string's preset frequency change while maintaining the relative pitch relationships between the strings and the preset rate of continual change and that with engaging arm shaft 28*a* in its neutral position, each string's frequency change is repetitiously repeated between its preset frequencies and at the preset rate of continual change.

Once all effect patch parameters have been selected, the performer now determines the combination of controls for engaging device functions via device engagement combination selection button 21. The controls for device engagement provide differing functional controlling signals to microprocessor 90 and they exist in variable and fixed formats. The variable format provides motion control information to microprocessor 90 and with the present invention, these devices include engaging arm 28, engaging pedal 28*p* and offboard wireless controller 28*w*. The fixed format provides specific status information to microprocessor 90 and with the present invention, these devices include onboard switches 27*c*, 27*cepon* and 27*eep*, pedalboard mounted switches and wireless controller switch 27*wc*.

Device engagement combination selection button 21 provides the performer with the desired combination of the present invention's fixed and variable controls. There were found to be eleven viable combinations. These include: (a) engaging arm 28 in combination with onboard switches 27*c*, 27*cepon* and 27*eep* ; (b) engaging arm 28 in combination with pedalboard mounted switches; (c) engaging pedal 28*p* in combination with onboard switches; (d) engaging pedal 28*p* in combination with pedalboard mounted switches; (e) offboard wireless controller 28*w* in combination with onboard switches 27*c*, 27*cepon* and 27*eep* ; (f) offboard wireless controller 28*w* in combination with pedalboard mounted switches; (g) engaging arm 28 in combination with onboard switches 27*c*, 27*cepon*, 27*eep* and also including wireless controller switch 28*wc*; (h) engaging pedal 28*p* in combination with onboard switches 27*c*, 27*cepon*, 27*eep* and also including wireless controller switch 27*wc*; (i) engaging pedal 28*p* in combination with pedalboard switches and also including offboard wireless controller switch 27*wc*; (j) offboard wireless controller 28*w* in combination with pedalboard switches and also including wireless controller switch 27*wc* and finally; (k) offboard wireless controller 28*w* in combination with pedalboard switches and also including wireless controller switch 27*wc*. The inclusion of wireless controller switch 28*wc* in combination with the onboard and pedalboard switches with some of the selection choices, provides the performer with the widest diversity of engagement capabilities. With these selection capabilities, the performer can easily select the combination of device controls for a specific patch by simply pressing device engagement combination selection button 21 until the desired combination appears upon display unit 29.

Because all aspects of string tension control relative to the effect patches are independent of frequency comparison during engagement of effect patch capabilities, presetting the number of pulses sent to each string's stepper motor to maintain relative pitch relationships between the strings is via patch button 27*p*. To set the number of pulses sent to each string's stepper motor relative to the same predetermined pitch interval, the performer initially tunes the instrument to its base tuning patch as described above. Making sure all of the tuning switches 24 are in the off position, the performer presses patch button 27*p*. With this, the step position of each string's stepper motor 30 with the string in tune is correspondingly considered zero position by microprocessor 90.

The performer now causes all strings to vibrate again. Each string's analog signal from its independent string transducer 50 is correspondingly processed as described above. Each tuned string now retunes to a preselected frequency below the string's normal frequency using the same frequency comparison process as previously described. An interval of a perfect fifth below the preselected frequency for that string in relation to its base tuning patch is the preferred interval for this calibration function. Rotation of frequency buttons 25 while in this mode, enables the player to reset the preselected comparison interval if desired. When display unit 29 indicates that all strings have retuned to the new preselected interval, the performer presses patch button 27*m*.. In doing so, the corresponding number of steps it has taken each string's stepper motor 30 to produce this relative interval is saved for each string within RAM 94. Each string's pulse number is correspondingly used as the controlling number relative to all effect patch frequency variations for that specific string. This simple system enables the performer to easily calibrate the present invention to the natural variations that occur with string diversities and instrumental materials. Once calibration is completed, the performer simply retunes the instrument as described above.

The Musical Instrument Digital Interface 100 included with the electronics of the present invention enables the player to tie in the present invention with other devices that include MIDI communication. MIDI is the standard interface for the transmission of electronic information between electronic musical devices. With this, the performer can automatically change and control certain functions of the present invention through other equipment. For example, a programmable effect system for an electric string instrument would include the present invention, (a) MIDI Mitigator by Lake Butler Sound Company, an MP-1 MIDI Controllable Preamp by ADA Signal Processors and an SGE Studio Super Effector by Applied Research and Technology. With such a system, implementing a patch change command or a system exclusive message via the Mitigator changes the devices, including the present invention, to the desired status and functions. This enables the performer to control certain functions of the string tensioning apparatus tuning, effect and continual capabilities via an alternate offboard device which frees the hands for independent play string techniques while still enabling the performer to engage the functions of the string tensioning apparatus during such play.

The above features of the string tensioning apparatus provide the performer with the means for the production of a diversity of harmonically correct monophonic and polyphonic vibrators, standard pitch variation effects and a myriad of novel, unique and aesthetically pleasing vibrato and pitch variation effects.

Alternative Hardwired Control Structure

FIGS. 12 through 15 are electronic diagram for a simplified hardware versions of the present invention that provide only for manual rotation control, automatic tuning, monophonic vibratos, relative pitch polyphonic vibratos, a variety of pitch variation effects and an electronic continual function. The rotation, automatic tuning and frequency variation circuits are shown separately to indicate that each function is viable independently or in combination with each other and each provides advantages over the prior art. With this type of format all device electronics may be contained onboard thus eliminating the need for the offboard device electronic enclosure 17, depending upon the combination of circuits used.

Figure 12:
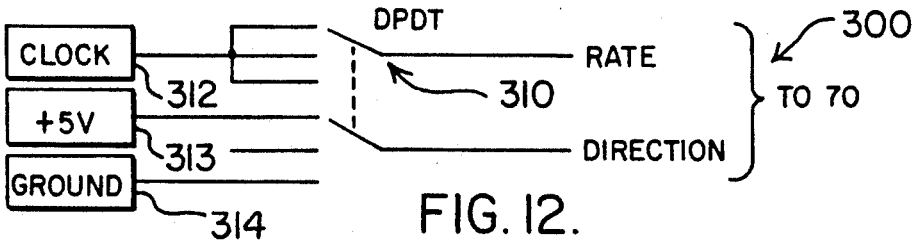
FIG. 12 is an electronic diagram illustrating a hardwire format for the present invention that provides for manual control of shaft rotation.
Figure 14:
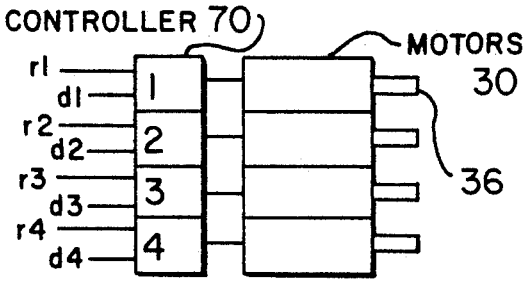
FIG. 14 is an electronic diagram illustrating motors and their corresponding controllers.

In reference to the hardwire manual rotation control circuit 300 of FIG. 12, each string's double pole double throw rotate switch 310, when engaged from its off position into either its clockwise or counterclockwise rotate position, supplies rotate pulses from clock 312 and digital directional control information from either the high binary logic source 313 or the low binary logic source 314, depending upon the position of rotate switch 310, to the engaged string's motor controller 70 of FIG. 14 which enables the performer to control the rotational direction of that string's motor's output shaft 36 and therefore string tension. When a string's rotate switch 310 is placed back into its off position, that string's motor 30 maintains its position and hold the string's tension at the desired level. This provides for string attachment ease and for the manual adjustment of string tensions for aural comparison tuning.

Figure 13:
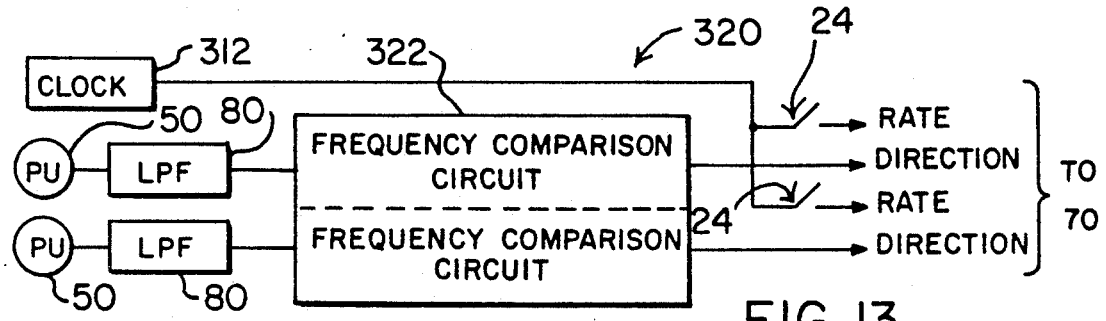
FIG. 13 is an electronic diagram illustrating a hardwire format for the present invention that provides for automatic string tuning.

The hardware electronic format of automatic tuning circuit 320 of FIG. 13 includes independent string transducers 50, LPFs 80 and tuning switches 24. The frequency comparison circuit 322 is shown as a simple block to indicate that many of the automatic tuning formats contained with the prior art and other formats yet to be developed are applicable for this function and with the proper implementation and variations, they are viable for the automatic tuning aspect of the present invention using a hardwire format wherein the performer may tune any combination of strings at any time. As illustrated, the output from each string's frequency comparison circuit 322 provides both rotational direction control and clock pulses to each string's motor controlling means 70 of FIG. 14. When a specific string's tuning switch 24 is turned on and the performer causes that specific string to vibrate, any discrepancy between the predetermined frequency for that specific string and the frequency of that specific string as supplied via that specific string's independent string transducer 50 as determined by that specific string's frequency comparison circuit 322, causes that specific string's frequency comparison circuit 322 to provide control signals to that specific string's motor controller 70 wherein these control signals alters the output shaft 36 of that specific string's motor 30 to vary that specific string's tension accordingly to bring that specific string into tune.

Figure 15:
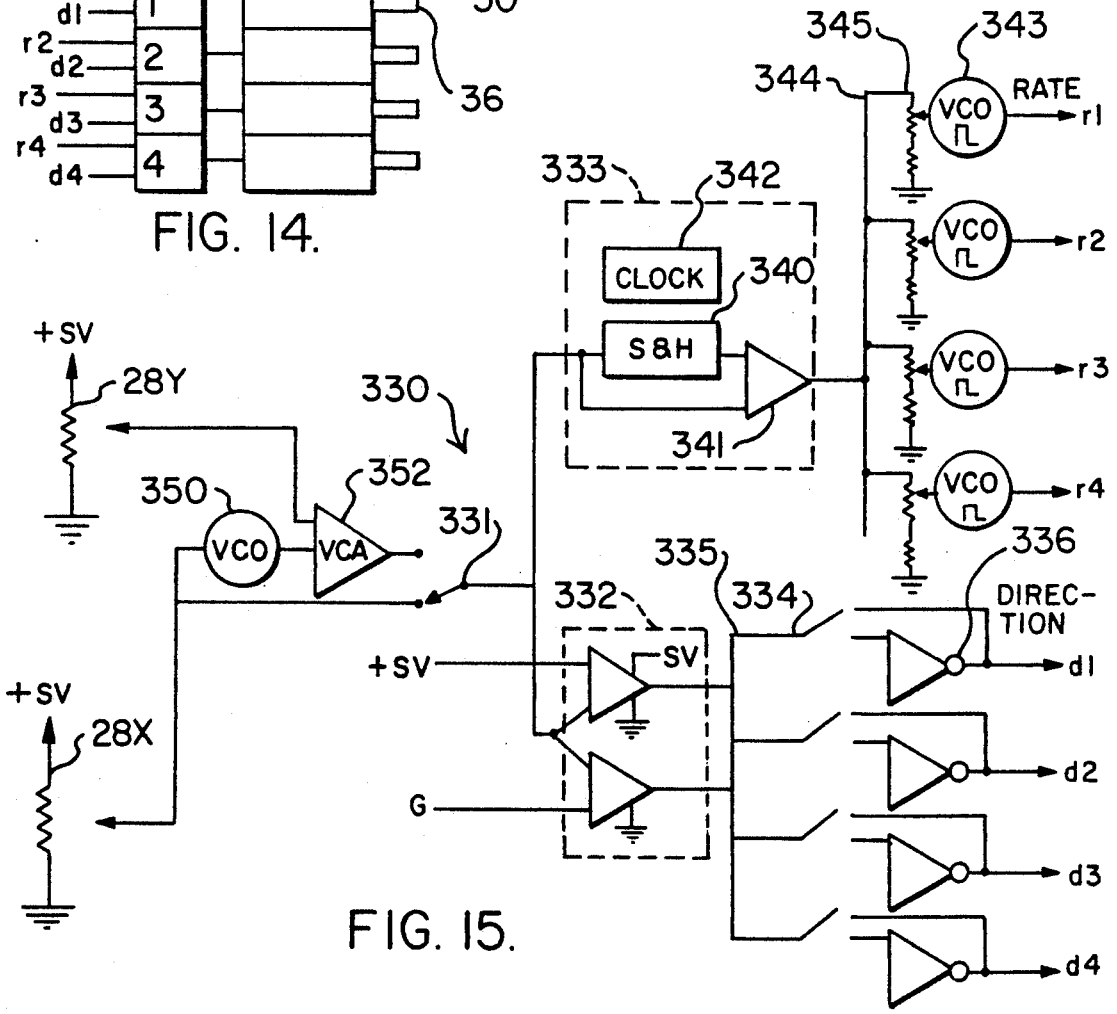
FIG. 15 is an electronic diagram illustrating a hardwire format for the present invention that provides for vibrato and continual functions though of a limited scope.

The hardwire circuit 330 of FIG. 15 provides for vibratos, frequency variation effects and for the continual function. During manual device engagement for vibratos, control over the rate and direction in which the motors 30 function relative to the rate and direction of displacement motion of engaging arm shaft **28*a*, engaging pedal 28*p* or offboard wireless controller 28*w* is displaced is via the following format. Each engaging apparatus includes a combination potentiometer and optical encoder that responds to the displacement motion of the engaging apparatus. Referring specifically now to the directional control of each string's motor relative to the displacement motion of the engaging means, the variable terminal of potentiometer 28*x* are applied to window detector 332**.

Window detector 332 provides digital logic relative to the directional displacement motion of engaging arm shaft **28*a*, engaging pedal 28*p* or wireless controller 28*w* wherein with such a format, a positive displacement away from the surface of the instrument produces a signal level corresponding to one binary logic level and correspondingly, motion towards the surface of the instrument produces the complementary binary logic level. The logic level output from window detector 332 is applied to each string's invertor switch 334. This switch either bypasses or applies the signal to each string's binary invertor 336 depending upon the position of invertor switch 334. Each string's binary invertor 336 produces at its output the complementary binary logic level relative to the binary input level. Depending upon the setting of each specific string's invertor switch 334, either the original binary signal or its binary complement is applied to the directional control input of each string's specific motor controller 70 of FIG. 14**, thus controlling motor direction relative to the displacement direction of the chosen engaging means.

Motion detection circuit 33 determines the rate at which the variable potentiometer **28*x* is displaced. The input from variable potentiometer 28*x* is split and applied to sample and hold amplifier 340 and to comparator 341. Clock 342 determines the sampling rate at which the sample and hold amplifier 340 processes the signal from the variable terminal of potentiometer 28*x*. The capability of determining motion with this format is due to the time delay provided by the sampling rate of sampling hold amplifier 340. With this, one input of the comparator 341 receives real time values directly from the variable terminal of potentiometer 28*x* while the other input of comparator 341 receives a time delayed value from sample and hold amplifier 340. Because of this time delay comparison format, the faster the rate at which the variable terminal of potentiometer 28*x* is displaced, the greater the output of comparator 342. When there is no motion of the variable terminal of potentiometer 28*x*, there is no corresponding output from comparator 342**.

For independent control over the rate at which each string's motor 30 responds relative to the motion of the variable terminal of potentiometer **28*x*, the output from comparator 341 of motion detection circuit 333 is applied to each string's individual voltage controlled oscillator 343 via oscillator bus 344. Each specific string voltage control oscillator (VCO) 343 provides each string's specific motor controller 70 with the clock signals necessary to drive that specific string's motor 30 when the variable terminal of potentiometer 28*x* is in motion. The output from comparator 341 provides the necessary voltage to engage each string's VCO 343. Variation of the rate at which each string's VCO 343 responds relative to the rate at which the variable terminal of potentiometer 28*x* changes is adjusted via the oscillator potentiometer 345 of each string's specific VCO 343. The output of each string's specific VCO 343 correspondingly feeds the clock input of that specific string's motor controller 70 thus providing the necessary clock signals to drive the motor. With this format, the performer can adjust the rate of rotation of each string's motor 30 relative to the rate in which the engaging arm shaft 28*a*, engaging pedal 28*p* and/or offboard wireless controller 28*w* is engaged. Taken together, the adjustable rate of change and directional variation capabilities relative to the motion of the variable terminal of potentiometer 28***x* enables the performer to manually adjust the circuit to produce of the vibrato and frequency effects as described above.

In reference to the continual function, switch 331 placed in the continual position engages continual VCO 350 and voltage controlled amplifier 352 and replaces the manual engagement of potentiometer 28*x* for vibratos and other pitch variation effects with an electronic override. Using the joystick type of engaging apparatus as described above, potentiometer 28*x* controls the rate at which VCO 350 functions while potentiometer 28*y* controls the amplitude of the output of voltage controlled amplifier 352. With this electronic format, string direction and rate responses maintain the relationships as determined by the presets of inverter switches 334 and oscillator potentiometers 344 relative to the manual displacement motion of the variable terminal of potentiometer 28*x*. While functioning in the continual mode however this motion is electronically replaced by the wave shape, rate and amplitude supplied by VCO 350 and the voltage controlled amplifier 352. The present invention may include a multiplicity of VCO 350 wherein each produces a different wave shape such as sine, solitude and triangle for the production of unique continual effects.

Real time control over the rate of change and the frequency range of each string during the continual function is by displacement of one of the engaging apparatus described above. Using the displacement motions of the engaging arm shaft 28*a*, engaging pedal 28*p* and/or offboard wireless controller 28*w* as described above, position variation of the engaging apparatus corresponding alters the position of the variable terminals of their potentiometers 28*x* and 28*y* therefore controlling the rate and amplitude at which VCO 350 and voltage control amplifier 352 function under the control of the performer. Processing of the signal follows the format as described above to provide each string's motor controller 70 with the necessary logic and control signals. With this, the above hardware circuit thus provide the performer with a viable means for the production of vibratos, pitch variation effects and continual capabilities similar to the software version of this apparatus.

Many different types and designs of tensioning apparatus including hydraulic systems, pneumatic systems, magnetic systems, solenoids and differing motor types including linear actuators, alone and in combination with linear perpendicular, oblique and other types of camming and leveraging systems were considered for the mechanical aspect of the present invention. Structural variations of the present invention depends upon the type of instrument implementing the present invention. In reference to the electronic aspects of the present invention, there are many electronic formats capable of providing for certain functions of the present invention as the discussions of the prior art and the present invention showed and are not intended to be limiting. Depending upon the type of instrument implementing the present invention for its unique benefits, electronic information transfer techniques may vary from multiplexing certain systems to using pedals or other type of controller in place of the present invention's illustrative buttons and switches.

It is believed that the foregoing descriptions provide a novel and unobvious apparatus for controlling string tensions or musical string instruments wherein the string tensioning apparatus is simple in structure, uses devices presently available on the market, eliminates the usage of machine heads and tuning pegs as a means for controlling string tensions, eliminates all of the tuning problems related to the inherent position slippage of the machine heads and tuning pegs, provides for easy string attachment, eliminates all of the inherent tuning problems associated with tuning an instrument aurally, automatically tunes any combination of strings depending upon the discretion of the performer, allows for easy implementation of tuning variability in relation to other instruments, tuning standards and tuning relationships, provides for performer discretion in the production of harmonically correct monophonic vibratos, polyphonic vibratos, standard pitch variation effects and myriad of novel, unique and aesthetically pleasing vibrato and pitch variation effects never before possible with musical instruments without interfering with dependent and independent playing techniques, eliminates all of the associated problems of vibrato devices that use a means of resiliency for position memory, allows for easy control of device functions via MIDI, is adaptable with software, is easily adaptable to many existing instruments and is adaptable to instruments yet developed.

While the illustrative embodiment described above is an example of the present invention used with a lute-type of string instrument and includes many specificities, they are not to be construed as limitations on the scope of the present invention or on the types of string instruments capable of including the present intention for its unique benefits. Embodiment and electronic modifications and variation of the present invention in relation to the diversity of string instruments may become apparent to those with skill in the art and accordingly, the fundamental spirit of the present invention exists within the following appended claims.

I claim:

1. In a musical instrument having a plurality of strings, apparatus for dynamically controlling the tensioning of each of said plurality of strings independent of all of the remaining ones of said plurality of strings comprising:

a like plurality of motor means, each having a shaft connected to one end of a corresponding one of said plurality of strings for regulating the tension of said corresponding string, means for storing data indicative of a selected frequency of operation for each of said plurality of strings, means for measuring the frequency of operation of each of said plurality of strings, means responsive to said measuring means for determining the difference between said measured frequency of operation of each of said plurality of strings and said selected frequency of operation of each of said plurality of strings, means responsive to said determining means for activating each of said motor means to adjust said tension of said corresponding string for each of said plurality of strings for which said difference between said selected frequency of operation and said measured frequency of operation exceeds a predetermined threshold, means for converting said difference between said selected frequency of operation and said measured frequency of operation into a control signal indicative of the magnitude and direction of said determined difference for each of said plurality of strings, wherein each said motor means includes:

a bidirectionally operating motor having a rotating drive shaft, means for directly connecting said one end of said corresponding string to said drive shaft, means for translating said control signal generated by said activating means into motor drive signals to control the rotational position of said drive shaft.

2. The apparatus of claim 1 wherein said adjusting means further includes:

means for enabling a user to input data into said storing means, wherein said storing means is also operable to store data indicative of a succession of selected frequencies for each of said strings, wherein said storing means is further operable to store data indicative of the rate of change of frequency between two successive ones of said selected frequencies for each of said strings, means for selectively identifying to said processing means the presently desired one of said selected frequencies of operation in said succession of selected frequencies of operation for each of said plurality of strings.

3. The apparatus of claim 2 wherein said adjusting means further includes:

means for manually selecting the frequency of operation for at least one of said plurality of strings, means for switchably connecting either said storing means or said manually selecting means to said determining means to indicate said selected frequency of operation.

4. The apparatus of claim 2 wherein said selectively identifying means includes:

means for identifying the presently desired one of said selected frequencies of operation in said succession of selected frequencies of operation for at least two of said plurality of strings.

5. The apparatus of claim 1 wherein said adjusting means further includes:

means for enabling a user to input data into said storing means, wherein said storing mean sis also operable to store a plurality of sets of data, each of which is indicative of a rate and direction of change of frequency of operation for each of said strings, means for selectively identifying to said determining means the presently desired one of said stored sets of data for each of said plurality of strings.

6. The apparatus of claim 5 wherein said selectively identifying means includes:

means for identifying the presently desired one of said selected frequencies of operation in said succession of selected frequencies of operation for at least two of said plurality of strings.

7. The apparatus of claim 1 wherein said measuring means includes:

a like plurality of transducer means for converting the vibration of a corresponding one of said plurality of strings into electrical signals indicative of the frequency of vibration of said corresponding string.

8. The apparatus of claim 7 wherein said determining means includes:

means for selectively receiving said electrical signals from said plurality of transducer means, means for reading from said storing means said data indicative of said selected frequency of operation for the one of said plurality of strings corresponding to said selectively received transducer means.

9. In a musical instrument having a plurality of strings, each of said strings having a first and second end, apparatus for dynamically controlling the tensioning of each of said plurality of strings independent of all of the remaining ones of said plurality of strings comprising:

means for rigidly securing said first end of each of said plurality of strings;

means for adjusting the tension of said plurality of strings including:

a like plurality of motor means, each having a rotatable shaft connected to said second end of a corresponding one of said plurality of strings for regulating the tension of said corresponding string, means for storing data indicative of a selected frequency of operation for each of said plurality of strings, means for measuring the frequency of operation of each of said plurality of strings, processing means responsive to said measuring means for determining the difference in frequency of operation between each of said plurality of strings and the data in said storing means indicative of said selected frequency of operation of each of said plurality of strings, means for converting said difference between said selected frequency of operation and said measured frequency of operation into a control signal indicative of the magnitude and direction of said determined difference for each of said plurality of strings, means responsive to said processing means for activating each of said motor means to adjust said tension of said corresponding string for each of said plurality of strings for which said difference between said selected frequency of operation and said measured frequency of operation exceeds a predetermined threshold, wherein each of said motor means includes:

a bidirectionally operating motor having a rotating drive shaft, means for directly connecting said one end of said corresponding string to said drive shaft, means for translating said control signal generated by said activating means into motor drive signals to control the rotational position of said drive shaft.

10. The apparatus of claim 9 wherein said adjusting means further includes:

means for enabling a user to input data into said storing means, wherein said storing means is also operable to store data indicative of a succession of selected frequencies for each of said strings, wherein said storing means is further operable to store data indicative of the rate of change of frequency between two successive ones of said elected frequencies for each of said strings, means for selectively identifying to said processing means the presently desired one of said selected frequencies of operation in said succession of selected frequencies of operation for each of said plurality of strings.

11. The apparatus of claim 10 wherein said adjusting means further includes:

means for manually selecting the frequency of operation for at least one of said plurality of strings, means for switchably connecting either said storing means or said manually selecting means to said processing means to indicate said selected frequency of operation.

12. The apparatus of claim 10 wherein said selectively identifying means includes:

means for identifying the presently desired one of said selected frequencies of operation in said succession of selected frequencies of operation for at least two of said plurality of strings.

13. The apparatus of claim 9 wherein said adjusting means further includes:

means for enabling a user to input data into said storing means, wherein said storing means is also operable to store a plurality of sets of data, each of which is indicative of a rate and direction of change of frequency of operation for each of said strings, means for selectively identifying to said comparing means the presently desired one of said stored sets of data for each of said plurality of strings.

14. The apparatus of claim 13 wherein said selectively identifying means includes:

means for identifying the presently desired one of said selected frequencies of operation in said succession of selected frequencies of operation for at least two of said plurality of strings.

15. The apparatus of claim 9 wherein said measuring means includes:

a like plurality of transducer means for converting the vibration of a corresponding one of said plurality of strings into electrical signals indicative of the frequency of vibration of said corresponding string.

16. The apparatus of claim 15 wherein said processing means includes:

means for selectively receiving said electrical signals from said plurality of transducer means, means for reading from said storing means said data indicative of said selected frequency of operation for the one of said plurality of strings corresponding to said selectively received transducer means.

17. Apparatus for dynamically controlling the tension of each of a plurality of strings, each having first and second ends, of a musical instrument comprising:

means for rigidly securing said first end of each of said plurality of strings;

means for converting the vibrations of each of said plurality of strings into electrical signals indicative of the frequency of operation of said strings;

means for generating reference signals indicative of a selected frequency of operation for each of said strings;

means for comparing said electrical signal and said reference signals for one of said strings, independent of the other said strings, to produce a signal indicative of the magnitude and direction of the frequency difference between said electrical signals and said reference signals for one of said strings;

a like plurality of motor means, each connected to said second end of a corresponding one of said plurality of strings, for adjusting the tension of said associated string as a function of said signal indicative of the magnitude and direction of the frequency difference between said electrical signals and said reference signals for said corresponding string, wherein each of said motor means includes:

a bidirectionally operating motor having a rotating drive shaft, means for directly connecting said one end of said corresponding string to said drive shaft, means for translating said signal indicative of the magnitude and direction of the frequency difference between said electrical signals and said reference signals into motor drive signals to control the rotational position of said drive shaft.

18. The apparatus of claim 17 wherein said apparatus further includes:

means for storing data indicative of a succession of selected frequencies for each of said strings, and of the rate of change of frequency between two successive ones of said selected frequencies for each of said strings, means for selectively identifying to said comparing means the presently desired one of said selected frequencies of operation in said succession of selected frequencies of operation for each of said plurality of strings.

19. The apparatus of claim 18 wherein said selectively identifying means includes:

means for identifying the presently desired one of said selected frequencies of operation in said succession of selected frequencies of operation for at least two of said plurality of strings.

20. The apparatus of claim 17 wherein said adjusting means further includes:

means for storing a plurality of sets of data, each of which is indicative of a rate and direction of change of frequency of operation for each of said strings, means for selectively identifying to said comparing means the presently desired one of said stored sets of data for each of said plurality of strings.

21. The apparatus of claim 20 wherein said selectively identifying means includes:

means for identifying the presently desired one of said selected frequencies of operation for at least two of said plurality of strings.

22. Apparatus for dynamically controlling the tension of each of a plurality of strings, each having first and second ends, of a musical instrument comprising:

means for rigidly securing said first end of each of said plurality of strings;

a like plurality of bidirectionally operating motor means, each having rotting driving shaft directly connecting to said second end of an associated one of said plurality of strings, for adjusting the tension of said associated string;

clock means for producing a periodic signal to control the rate of rotation of said motor means;

means for generating a direction signal indicative of the desired direction of rotation of said motor means; and means, associated with each said motor means and responsive to said periodic signal and said direction signal, for controllably activating said associated motor means to rotate in a direction and rate indicated by said periodic and direction signals.

23. The apparatus of claim 22 further including:

means for determining the frequency of vibration of each of said strings; and means responsive to said determining means for generating said direction signal indicative of the desired direction of rotation of said motor means.

24. The apparatus of claim 23 wherein said generating means includes:

means for identifying whether said determined frequency is greater or less than a desired frequency; and means responsive to said identifying means for producing a first signal indicative of said determined frequency being greater than said desired frequency and a second signal indicative of said determined frequency being less than said desired frequency.

25. The apparatus of claim 24 wherein said controllably activating means is responsive to said first signal for rotating said motor means in a first direction to reduce the tension of said associated string and to said second signal for rotating said motor means in a second direction, opposite of said first direction, to increase the tension of said associated string.

26. The apparatus of claim 22 further including:

control means for enabling a performer to produce a periodic signal and a direction of change of frequency, respectively, for at least one of said strings.

27. The apparatus of claim 26 wherein said control means includes;

manually operable control arm for translating multidirectional displacement of said manually operable control arm into corresponding electrical signals indicative of the magnitude and direction of said displacement.

28. The apparatus of claim 27 wherein said control means further includes:

means, responsive to said electrical signals, for producing said periodic signal to control the rate of rotation of said motor means; and means, responsive to said electrical signals, for generating said direction signal indicative of the desired direction of rotation of said motor means.

29. The apparatus of claim 28 wherein said producing means includes:

means for controllably adjusting said periodic signal for said associated motor means to individually vary said rate of rotation for said motor means and thereby the rate of frequency change for said associated string.

* * * * *